US005349803A

United States Patent [19]

Nute, Jr.

[11] Patent Number: 5,349,803

[45] Date of Patent: Sep. 27, 1994

[54] LANCED FIRE-RATED RUNNER

[75] Inventor: Ernest B. Nute, Jr., Lancaster, Pa.

[73] Assignee: Armstrong World Industries, Inc., Lancaster, Pa.

[21] Appl. No.: 72,392

[22] Filed: Jun. 7, 1993

[51] Int. Cl.[5] ..... E04C 2/42; E04C 2/52

[52] U.S. Cl. ..... 52/573.1; 52/506.07; 52/1; 52/DIG. 5; 52/232

[58] Field of Search ..... 52/573.1, 506.07, 1, 52/DIG. 5, 232

[56] References Cited

U.S. PATENT DOCUMENTS

| | | | |
|---|---|---|---|
| Re. 33,501 | 12/1990 | Platt et al. | 52/232 |
| 1,447,055 | 2/1923 | Averill | 52/232 |
| 3,175,655 | 3/1965 | Brown et al. | 52/232 |
| 3,189,138 | 6/1965 | Znamirowski | 52/232 |
| 3,189,139 | 6/1965 | Znamirowski et al. | 52/232 |
| 3,388,519 | 6/1968 | Downing, Jr. | 52/232 |
| 3,390,503 | 7/1968 | Emerick, Jr. et al. | 52/232 |
| 3,397,501 | 8/1968 | Jahn | 52/232 |
| 3,496,690 | 2/1970 | Jahn | 52/232 |
| 3,589,089 | 6/1971 | Kredel | 52/232 |
| 4,016,701 | 4/1977 | Beynon | 52/573.1 |
| 4,128,978 | 12/1978 | Beynon | 52/232 |
| 4,598,514 | 7/1986 | Shirey | 52/232 |
| 4,785,595 | 11/1988 | Dunn | 52/232 |
| 4,893,444 | 2/1990 | Ollinger et al. | 52/232 |

*Primary Examiner*—Carl D. Friedman
*Assistant Examiner*—Wynn E. Wood

[57] ABSTRACT

The grid member is formed of sheet metal and has an inverted T-shape with a bulb at the top, a double thickness central web and oppositely disposed flanges at the bottom. To achieve controlled expansion, an extended angular lance is cut at the top of the bulb. Further, staggered cutouts are placed in the two thicknesses which make up the web. By staggering the cutout areas of adjacent web layers, the overall web strength is maintained. These web cutouts and the lance at the top of the bulb cooperate upon thermal expansion, causing the bottom flanges to buckle down, and the web and bulb to separate laterally and fold. The folded web configuration directed by the staggered cutout pattern will maintain longitudinal rigidity.

3 Claims, 2 Drawing Sheets

Fig. 2
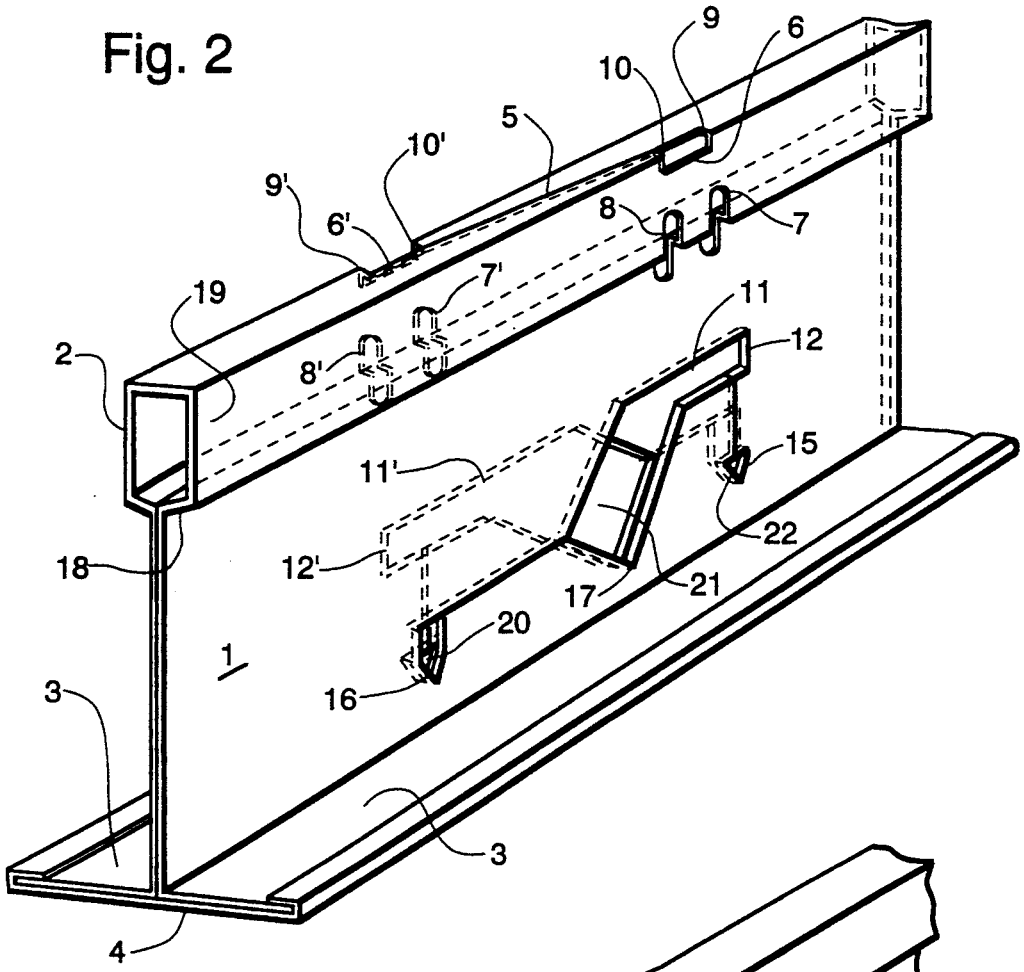
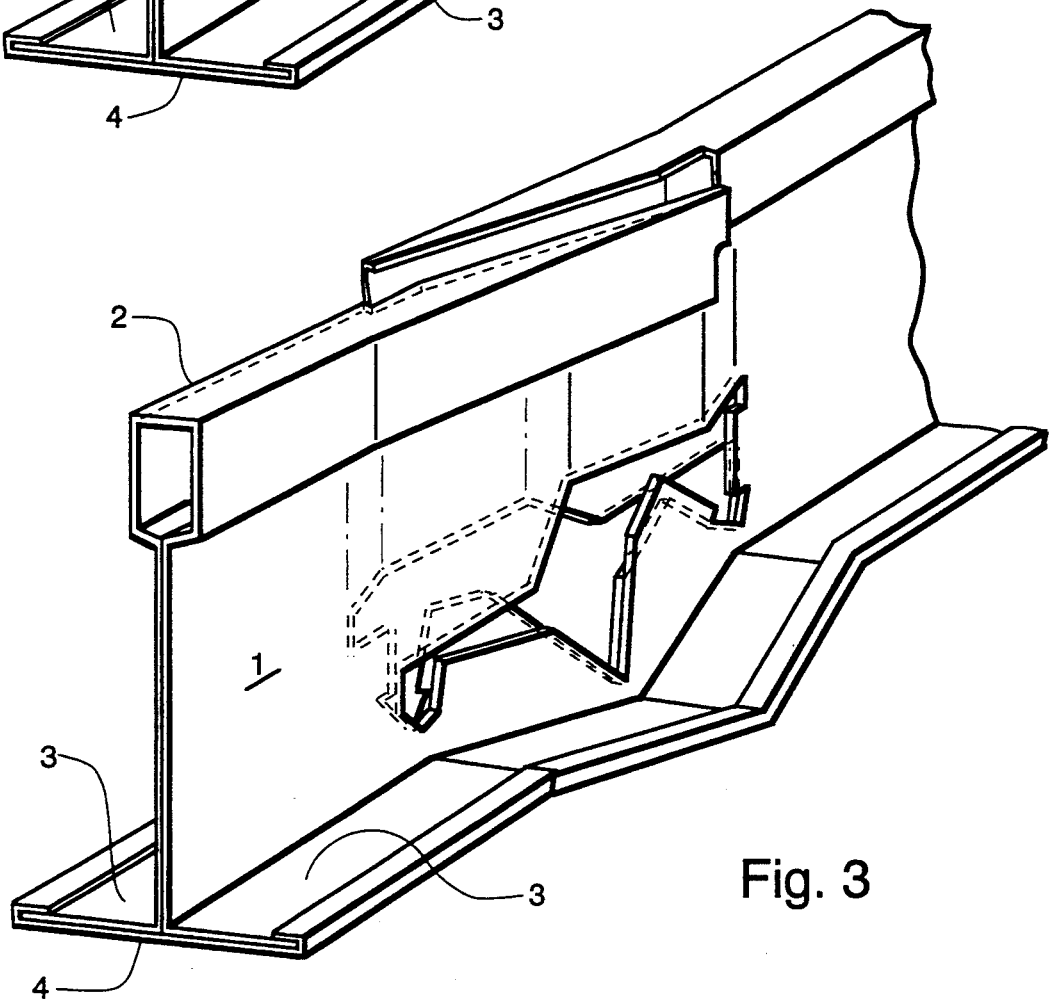
Fig. 3

LANCED FIRE-RATED RUNNER

BACKGROUND OF THE INVENTION

Field of the Invention

This invention relates generally to a fire-resistant, ceiling board supporting grid system, and more particularly, to runner members capable of absorbing compressive elongation without substantial buckling as might occur during abnormal elevated temperatures, thereby preserving the integrity of the ceiling as a fire barrier under such conditions.

One of the critical problems encountered in these supporting grid structures is to maintain integrity under abnormally elevated temperatures, such as during a fire. Under these high temperature conditions, metallic grid members, which generally are fixed at their end points, expand and buckle whereby the supported ceiling panels are displaced and drop through the openings formed by the buckled grid members. As a result, the effectiveness of the suspended ceiling as a fire barrier is destroyed and the support structure is exposed to fire.

Prior art has considered structures for absorbing thermally induced compression in a supporting grid member. Most of the early designs used multiple expansion joints in a main runner. A relatively close placement of expansion joints will perform best in fire. This is because, when subjected to fire, the intersecting cross tees will remain close to their original spacings and thereby continue to support the panels. The early systems, however, were severely weakened at their expansion relief locations and could not be installed efficiently without excessive handling damage. Further, they were weak in cross bending and could not maintain beam alignment when exposed to fire.

To resolve this problem, some of the commercial systems reverted to main beams with only one relief point located near the end of the runner (reference U.S. Pat. No. 3,388,519). This however, reduced the handling problem at the expense of optimum fire performance.

Over the years there have been step-by-step improvements in systems that use multiple relief points in each main runner. However, the above problems, to a lesser degree, remain valid even in the improved systems. U.S. Pat. Nos. 3,778,947, 3,965,631 and 4,606,166 show products that handle marginally well when the web is kept vertical. The crushed bulb of these designs, however, limits handleability. This is especially true when a beam is handled on its side. U.S. Pat. Nos. 4,016,701 and 4,128,978 show products with metal removed from the top of the bead. This is the area of maximum bending stress, and the removal of metal here will significantly reduce load carrying capacity.

SUMMARY OF THE INVENTION

Accordingly, one object of the present invention is to provide an improved fire-rated grid member which absorbs longitudinal compression resulting from extreme heat and provides controlled deformation at predetermined areas so as to preserve the integrity of a supported fire-resistive ceiling.

Another object of this invention is to provide a fire-rated grid member with multiple relief points, which is less fragile to damage in handling.

Still another object of the present invention is to provide a grid member with stronger expansion relief areas, which can better withstand ceiling loads in a normal situation and at extreme temperatures.

A further object of the present invention is to provide an improved fire-rated grid member which may be manufactured with less complex tooling.

In summary, the present invention provides a fire-rated grid member with multiple areas which provide expansion relief when exposed to high temperatures. The grid member is formed from a strip of metal into the shape of an inverted T-shape with a bulb at the top, a double thickness central web and oppositely disposed flanges at the bottom.

The areas of expansion are configured with a lance across the top of the bulb. Metal is removed from the top of the bulb at the ends of the lance. The bulb is not crushed or formed in a manner which could weaken the section to lateral bending. A knock-out pattern is placed in the two web thicknesses. These web cutting patterns occur staggered on the adjacent web thicknesses to maintain greater strength. When the grid member is put into compression, as would occur in high temperatures, the expansion relief area will buckle in a controlled manner. The flange will fold down, and the bulb and webs directed by the cut and lance patterns will slip laterally past each other. A relatively rigid section will remain after the expansion relief has occurred.

BRIEF DESCRIPTION OF THE DRAWINGS

FIG. 2 is a perspective view of the expansion relief area within the grid member. Hidden lines are used to show the web cutouts hidden from view.

FIG. 3 is a perspective view of the grid member which has undergone thermal expansion.

DESCRIPTION OF THE PREFERRED EMBODIMENTS

Figure 1:
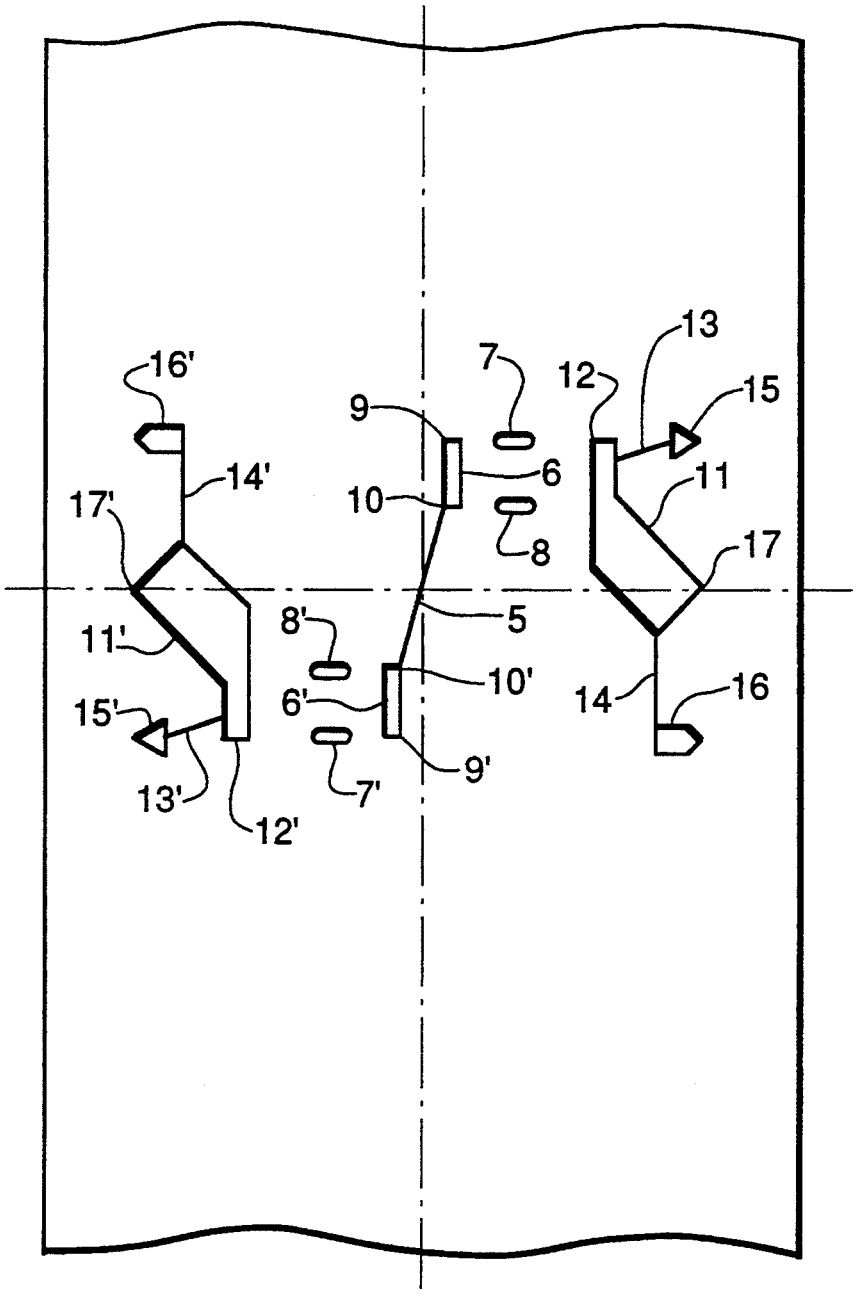
FIG. 1 is a segment of the metal strip before it is formed into a T-section. The segment shows the cutout pattern which becomes the expansion relief area of the grid member.

Referring to FIGS. 2 and 3, there is shown a fire-rated runner having an inverted T construction which includes a central web 1, having a bulb 2 at the top and a pair of oppositely disposed flanges 3 at the bottom for supporting ceiling panels. The fire-rated runner is of a double web type in which a strip of sheet metal is bent intermediate its longitudinal edges to form the bulb 2 with the portion of the strip at opposite sides of the bulb being brought into parallel relation to form web 1 and the edge portions of the strip being bent at right angles thereto to form the oppositely disposed flanges 3. A separate decorative cap 4 covers the flanges and is formed by a strip of material having its longitudinal edges folded around the adjacent edges of the associated flanges 3. The runner just described is generally of standard construction as utilized in the trade.

At the top of the bulb is an elongated angled lance 5. With an extreme compressive force longitudinal to the bulb, one side of the angled lance is urged to slip past the other side of the angled lance. Then as this compressive slippage starts to occur, due to the angular shape of the lance, the bulb is urged laterally in both directions.

Note the rectangular cutout 6 that terminates one end of lance 5. One edge of the rectangle falls on the top of the bulb and one edge of the rectangle falls on the side wall of the bulb. Note the oval cutouts 7 and 8 which remove metal from one side of the web and the bottom wall 18 and side wall 19 of the bulb. The center lines of the ovals 7 and 8 are in alignment with the opposite ends 9 and 10 of rectangle 6.

An identical, but reversed, lance and cut configuration occurs at the opposite side of the top of the bulb 6' and the opposite side of the web 7' and 8' and rectangle ends 9' and 10'.

Now as a compressive force urges opposite sides of the angled lance 5 to separate and the bulb is thereby urged laterally in both directions, staggered metal hinge lines develop at 7–9, 8–10, 7'–9' and 8'–10'. As the compression continues, the metal about these four hinge lines can move up to 180°. As shown in FIG. 3, lines 8–10, 8'–10' have made about a 75° arc around lines 7–9 and 7'–9', respectively.

In order for the above to occur, there must be equal longitudinal expansion relief in the web and in the bottom flange. Cutouts 11 and 11' account for the controlled expansion relief in the two web thicknesses. Additional hinge lines develop at 7–12, 7'–12', and from 8 to cutout 11 and 8' to cutout 11'. The web metal adjacent to these hinge lines will move in sequence with the bulb metal as noted above. An optional feature to this invention would be to crease the above-noted hinge lines a small amount in the direction they are to function.

As the bulb and the web relieve expansion by one side rotating laterally around the other side, the flange 3 will buckle downwardly. The lower edge of cutouts 11 and 11' and lances 13, 13', 14 and 14' free the flange from the web at the expansion relief area. The points of the cutouts 15, 16, 15' and 16' along with point 17 and 17' on cutout 11 and 11' are in close proximity to the flange to permit the flanges to buckle. Lances 13, 13', 14 and 14' direct the flange to buckle down and not up. The edges of these lances could be deformed to increase the apparent width of the metal to further insure proper operation.

FIG. 3 shows the relief area of the main runner partly collapsed in the above-described controlled manner.

Features unique to this invention make this expansion relief stronger than the earlier designs.

The lance across the top of the bulb terminating at the rectangular cutouts allows the bulb to collapse but provides good resistance to lateral forces during installation.

Further, the bulb is not weakened by forming or crushing intended to direct expansion relief as in earlier designs.

A totally unique feature to this invention is the staggered cut and lance pattern on the two adjacent web pieces. There are only small areas 20, 21, and 22 where both web thicknesses are cut through in the same place. This enhances twist resistance and handleability. Where one side of the web is weakened for expansion relief, the other adjacent side of the web remains intact to resist distortion. All the lances end at cutouts. This is an aid to manufacturing and insures proper function in the event of thermal expansion by insuring that hinge point locations are not adversely affected by dull lance tooling. The ovals 7, 7', 8, and 8' remove a minimum amount of metal to insure easier roll forming and greater load carrying capability after thermal expansion has occurred.

What is claimed is:

1. A fire expansion section for a ceiling runner wherein:

(a) the ceiling runner has a vertical web member having at its upper end a bulb-shaped element with two spaced side walls, a bottom wall and a top wall, and at its lower end oppositely positioned flanges on either side of the web to support ceiling boards, said web member consisting of two side-by-side pieces of metal, each piece connected at the bottom of the web to a flange and connected at the top of the web to the bottom wall of the bulb; and (b) said fire expansion section being located between the ends of the ceiling runner comprising:

(1) a slit cut in the top wall of the bulb-shaped element extending from one side wall to the other side wall;

(2) a rectangular cutout in part of the top wall and part of the side wall of the bulb at each end of the slit;

(3) a web cutout in one piece of the metal of the web at the top of the web adjacent the bulb bottom wall near and below one end of the slit and a corresponding cutout similarly located in the other piece of metal of the web near and below the other end of the slit:

(4) said bulb side walls being unconnected at their lower end adjacent the web;

(5) three evenly spaced apart cuts in the web near the flanges, the center cut at its lower end being V-shaped with the point of the V-shape positioned near the flange to form a notch, the center cut being cut through both pieces of metal forming the web, the cut on the side of the center notch being cut through both pieces of metal forming the web with the cut located below the web cutout in the same piece of metal, the cut on the other side of the center notch being cut through both pieces of metal forming the web and positioned in the same manner as the cut on the said one side; and (6) the upper ends of the three cuts being connected by a severance of the metal above the cuts.

2. A fire expansion section for a ceiling runner as set forth in claim 1 wherein:

(a) the severance of the metal above the cuts is a removal of metal above the said side cut in the metal and a slit cut in the metal adjacent the said other side cut.

3. A fire expansion section for a ceiling runner as set forth in claim 1 wherein:

(a) the web cutout in one piece of the metal of the web at the top of the web extends into the bottom wall and side wall of the bulb, said web cutout is two adjacent cutouts on each side of the bulb.

* * * * *